US006213458B1

(12) United States Patent
Tamura et al.

(10) Patent No.: US 6,213,458 B1
(45) **Date of Patent: *Apr. 10, 2001**

(54) DOCUMENT SHEET FEEDING APPARATUS

(75) Inventors: Hitoshi Tamura, Hachioji; Hirohiko Okabe, Tokorozawa; Minoru Kawano; Katsunori Takahashi, both of Hachioji, all of (JP)

(73) Assignee: Konica Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/092,173

(22) Filed: Jun. 5, 1998

(30) Foreign Application Priority Data

Jun. 11, 1997 (JP) ..... 9-153507
Jun. 11, 1997 (JP) ..... 9-153508
Jun. 12, 1997 (JP) ..... 9-155136

(51) Int. Cl.[7] ..... B65H 5/00
(52) U.S. Cl. ..... 271/10.11; 271/114
(58) Field of Search ..... 271/10.11, 114

(56) References Cited

U.S. PATENT DOCUMENTS 4,678,178 * 7/1987 Akiyama et al. ..... 271/242
5,085,420 * 2/1992 Sata ..... 271/114
5,209,465 * 5/1993 Sayama et al. ..... 271/110
5,219,155 * 6/1993 Kanome ..... 271/114
5,305,996 * 4/1994 Taniwa et al. ..... 271/22
5,672,019 * 9/1997 Hiramatsu et al. ..... 271/902 X

FOREIGN PATENT DOCUMENTS 63-225037 * 9/1988 (JP) ..... 271/114

* cited by examiner

*Primary Examiner*—Christopher P. Ellis
*Assistant Examiner*—Richard Ridley
(74) *Attorney, Agent, or Firm*—Jordan B. Bierman; Bierman, Muserlian and Lucas

(57) ABSTRACT

A sheet feeding apparatus for picking up, aligning, and feeding single sheets from a stack of a plurality of such sheets. The apparatus includes a driving means for the pick up, separator, and sheet feeder having a driving motor with a coupling in the drive path which is capable of providing a delay period between forward and backward rotations of the motor. There is a torque regulator between the coupling and a reverse roller which interrupts the driving force for a predetermined time. The apparatus also includes a control which stops the registration rollers while the single sheet collides with the circumferential surfaces thereof for alignment and, upon reversal of the driving motor, the sheet is fed while the reverse roller first stops for the predetermined time and then rotates in a direction opposite to the direction of feeding. Thus, the single sheets are aligned and double feeding is prevented.

2 Claims, 11 Drawing Sheets

DOCUMENT SHEET FEEDING APPARATUS

BACKGROUND OF THE INVENTION

This invention relates to paper feeding apparatus such as a paper feeding means for an automatic document feeder attached to a recording apparatus for an electrophotographic copying machine or an image reading apparatus, a paper feeding cassette, a paper feeding means for feeding paper sheets from a paper feeding apparatus with large capacity, and a paper refeeding apparatus for feeding paper sheets having been subjected to recording from a stacker for recording on the reverse sides.

Each of the above-mentioned paper feeding means separates and feeds a sheet of paper from a paper feed tray (stacking tray) receiving a plurality of paper sheets to next process.

An automatic document feeder, for example, is composed of a paper feed tray, paper feeding means, transport means, and paper discharging means. The paper feed tray is composed of a document carrying stage for carrying a plurality of document sheets and a movable width regulating plate for aligning the side edges of document sheets. The paper feeding means separate a sheet out of the stack of the document sheets placed on the paper feed tray and feed it to an image reading portion on a document placing board (glass platen). The transport means transport, with an endless belt or a roller provided rotatably on the glass platen, the document sheet fed onto the upper side of said glass platen along its surface to a predetermined position, where it is stopped and later conveyed out by the transport means after its image being read. The paper discharging means eject the document sheet thus conveyed out from the transport means onto an exit tray or the paper feed tray, or invert the document sheet conveyed out from the transport means upside down and transport it onto the glass platen again, where it is subjected to the reading of the image on its reverse side.

A paper feeding apparatus of the type such as to separate and feed a paper sheet out of sheets of paper carried on a paper feed tray for carrying paper sheets is composed of (1) conveying-out means made up of a pick up roller for conveying out the paper sheets carried on the paper feed tray and a movable pressing plate, (2) separating means made up of a feed roller and a reverse roller (separation roller) for separating the sheets of paper conveyed out by said conveying-out means to pick up one for feeding, (3) a pair of registration rollers for adjusting the posture of the paper sheet separated and conveyed by said separating means, making it to be in a ready state, and feeding it again in response to a re-feeding signal, (4) drive means for driving each of these means, and (5) control means for controlling the driving of said drive means.

The paper feeding apparatus having above-mentioned composition has following subjects to be solved.

(1) In the paper feeding operation in the above-mentioned paper feeding apparatus, the paper sheet conveyed by the aforesaid conveying-out means and separating means reaches the pair of registration rollers to contact with the outer surface, where it is corrected for its skew to be in ready position, then in response to the re-starting signal the pair of registration rollers rotate to feed it again.

Regarding this operation for correcting the skew of the paper sheet, it has been heretofore carried out with an electromagnetic clutch the switching operation between stop and normal rotation of the registration roller pair. This switching with an electromagnetic clutch has such problems that (1) the apparatus is made to be of high manufacturing cost due to the use of a high-cost electromagnetic clutch, (2) when being actuated, the electromagnetic clutch generates noises such as shock noise etc., (3) the position of stopping of the document sheet conveyed onto the glass platen by the rotation of the pair of registration rollers is uncertain, and so forth.

(2) In the paper feeding apparatus of prior art, the movable pressing plate for pressing the pick-up roller in the conveying-out means presses the roller until the leading edge of the conveyed paper sheet reaches the nip position of the feed roller and the reverse roller in the separating means. However, in some cases the feeding operation of the feed roller is less effective than the reversing operation of the reverse roller, whereby the leading edge of the paper sheet does not reach the pair of registration rollers, resulting in failure of paper feeding.

(3) On condition that the peripheral speed of the pick-up roller and that of the feed roller are equal, the paper sheet extended between the pick-up roller and the feed roller becomes a load to the feed roller, which makes the separation and feeding of paper sheets unreliable.

(4) When the pair of registration rollers rotate to feed the paper sheet, if the reverse roller rotates at the same time by the reverse rotating drive of the drive motor, sometimes the paper sheet is made to get back with its leading edge made apart from the nip position of the registration rollers, resulting in no feeding by the registration rollers, which makes the cause of the paper feeding failure.

(5) The drive motor for driving the movable pressing plate to move up and down in the conveying-out means of prior art is fixed directly to the paper feeding apparatus mainframe with screws and the like, hence when said drive motor is driven to rotate normally or reversely, the vibration generated in the drive motor due to rotation is transmitted to the paper feeding apparatus mainframe where an abnormal noise is generated.

(6) If a buffer member is fitted in the mounting portion of the supporting member for holding the drive motor in order to prevent this abnormal noise, it increases the number of component parts to make the manufacturing cost higher.

(7) In the paper feeding operation in the above-mentioned paper feeding apparatus, a preceding paper conveyed by said conveying-out means and separating means is transported by the normally rotating pair of registration rollers to the next processing station, and upon passing of its trailing edge through the nip position ($P_2$ point) of the feed roller and the reverse roller, the feed roller is driven to rotate reversely by the reverse rotation of the reverse roller pressing the feed roller, and at the same time, the pick-up roller which is connected to this reverse roller with a belt is also driven in the reverse way to give a force acting on the following paper sheet to get back to the upstream side of feeding. In case of a considerable number of paper sheets to be fed, sometimes the reverse rotation of the reverse roller and the feed roller makes the following sheets get back to the upstream side of the feeding to such a degree, that the leading edge of the paper sheets are transferred to the upstream side apart from the feeding pressure point ($P_1$ point) where the pick-up roller is pressed by the movable pressing plate, resulting in the impossibility for the following paper sheet to be conveyed.

(8) In the paper feeding apparatus of prior art, a small number of sheets out of a large number of sheets is conveyed out, by the normal rotation drive of the feed roller and the pressing force of the movable pressing plate in the conveying-out means, to the press-contact point of the feed roller and the reverse roller, however, in the case where a paper sheet with a large curl is conveyed, sometimes the leading edge of the paper sheet does not reach the nip position of the feed roller and the reverse roller so long as only the pick-up roller is employed, resulting in paper feeding failure.

SUMMARY OF THE INVENTION

An object of this invention is to solve the above-mentioned problems, and to eliminate the problems experienced in the process of conveying-out, separating and feeding, and registration of paper sheets, for stabilizing the process.

Another object of the invention is to prevent the abnormal noise generated in the drive motor rotating in normal or reverse way at the time of conveying-out of a paper sheet in every kind of paper feeding apparatus.

The first structure for accomplishing the above-mentioned objects is a paper feeding apparatus comprising paper feeding means whereby paper sheets stacked on a paper tray are conveyed by conveying means, one of said sheets is separated and fed to a pair of registration rollers, where it is corrected for its skew, and again transported to next process, drive means for driving said paper feeding means, and control means for controlling the drive of said drive means, wherein a sheet of paper is separated and conveyed by revolution of said conveying means and separating means driven by normal rotation of a drive motor provided in said drive means to reach the peripheral surface of a pair of stationary registration roller, where it is ready to re-start with its skew in posture corrected, and next the drive motor is switched to reverse rotation by said control means, to transport said paper sheet again by the rotation of said pair of registration rollers driven by said reverse rotating drive motor.

Further, the second structure is a paper feeding apparatus comprising paper feeding means whereby paper sheets stacked on a paper tray are conveyed by conveying means, and one of said sheets is separated and fed to a pair of registration rollers, where it is corrected for its skew, and again transported to next process, drive means for driving said paper feeding means, and control means for controlling the drive of said drive means, wherein said conveying means is made up of a pick-up roller being rotated in normal way by said drive means, and a movable pressing plate capable of moving up and down for bearing the leading end portion of paper sheets stacked on said paper tray and pressing them upward from under side to the pick-up roller side, and said movable pressing plate continues to press said paper sheets until the leading edge of said one of sheets reaches the nip position of said pair of registration rollers through said separating means.

Furthermore, the third structure is a paper feeding apparatus comprising paper feeding means whereby paper sheets stacked on a paper tray are conveyed by conveying means, and one of said sheets is separated and fed to a pair of registration rollers, where it is corrected for its skew, and again transported to next process, and drive means for driving said paper feeding means, wherein said conveying means is made up of a pick-up roller being rotated in a normal way by said drive means, and a movable pressing plate capable of moving up and down for bearing the leading end portion of paper sheets stacked on said paper tray and pressing them to contact the pick-up roller, and said drive means has a first drive motor for driving said pick-up roller, said separating means, and said pair of registration rollers, and a second drive motor for driving said movable pressing plate to move up and down, said first drive motor being fixed to the paper feeding apparatus mainframe with an elastic buffer member inserted between them, said second drive motor being mounted to said first drive motor through a supporting member.

Further, the fourth structure is a paper feeding apparatus comprising paper feeding means whereby paper sheets stacked on a paper tray are conveyed by conveying means, one of said sheets is separated and fed to a pair of registration rollers, where it is corrected for its skew, and again transported to next process, drive means for driving said paper feeding means, and control means for controlling the drive of said drive means, wherein said separating means is made up of a feed roller driven to rotate normally, and a reverse roller driven to rotate reversely to press said feed roller, and a one-way clutch is fixed to the rotary shaft of said feed roller so that it may prevent said feed roller from rotating reversely driven by said reverse roller on the occasion of its reverse rotation.

Besides, the fifth structure to solve the above-mentioned problems is a paper feeding apparatus comprising paper feeding means whereby paper sheets stacked on a paper tray are conveyed by conveying means, one of said sheets is separated and fed to a pair of registration rollers, where it is corrected for its skew, and again transported to next process, drive means for driving said paper feeding means, and control means for controlling the drive of said drive means, wherein said conveying means is made up of a pick-up roller being rotated in normal way, and a movable pressing plate for bearing the paper sheets to be fed and pressing them to contact the pick-up roller, and said separating means is made up of a feed roller driven to rotate in normal way, and a reverse roller driven to rotate reversely to press said feed roller, and drive force transmitting belt means trained around the drive shaft of said pick-up roller and the driven shaft of said feed roller transmit the drive force from a drive shaft to a driven shaft, while the outer surface of the rotatable timing belt making up said drive force transmitting belt means is made of a high-friction material so that said high-friction material may make rubbing contact with the leading edge portion of the paper sheet passing through the nip portion of said pick-up roller and said feed roller to assist transporting by the rotation of said timing belt.

DETAILED DESCRIPTION OF THE PREFERRED EMBODIMENT

In the following, a mode of practice of the paper feeding apparatus according to this invention will be explained with reference to attached drawings.

Figure 1:
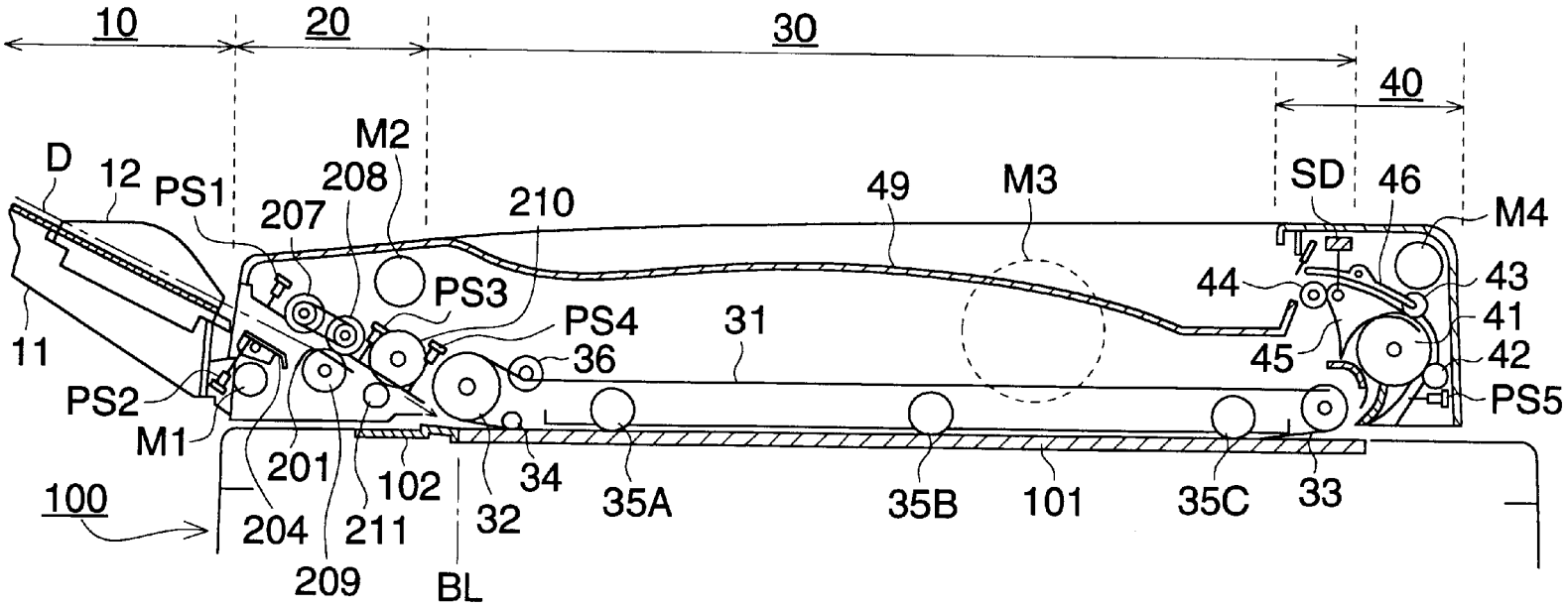
FIG. 1 is a cross-sectional view of an automatic document feeder to which this invention is applicable.
Figure 2:
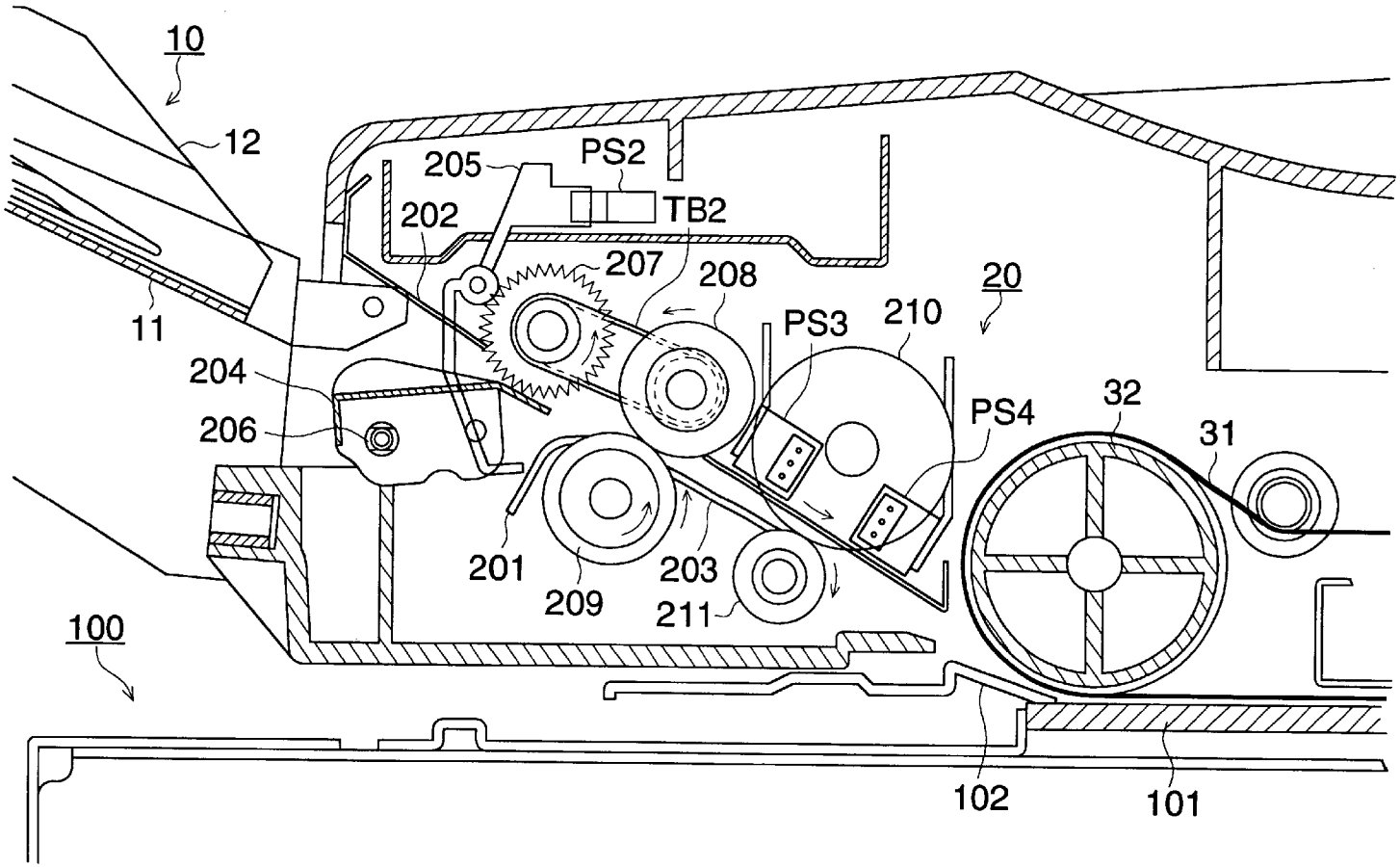
FIG. 2 is a cross-sectional view of the paper feeding portion of said automatic document feeding apparatus.

FIG. 1 is a cross-sectional view of an automatic document feeder to which this invention is applicable, and FIG. 2 is a cross-sectional view of the paper feeding portion of said automatic document feeding apparatus.

The automatic document feeding apparatus (hereinafter, referred to also as ADF) has two functions, that is, an ADF mode, wherein a document D composed of a plural paper sheets (single-sided document or double-sided document, hereinafter referred to as document sheets) is conveyed out by the paper feeding means 20 from the position on the document carrying station 11 (hereinafter referred to as paper feed tray), and one of the sheets is transported by the transport means 30, after being subjected to the exposure process on the document bearing board (glass platen) 101 of an image reading apparatus mainframe or a copying machine mainframe 100, and ejected onto the exit tray 49 by the paper discharging means 40, and an R-ADF mode, wherein the document sheet D is once ejected from the position on the glass platen 101 after exposure to be inverted upside down, and again it is transported onto the glass platen for exposure, then the document sheet D after exposure is ejected onto the exit tray 49.

The ADF is composed of the document carrying portion 10, paper feeding means 20, transport means 30, and paper discharging means 40.

The document carrying portion 10 is composed of the paper feed tray 11 capable of carrying the document sheets D, being mounted to the mainframe of the ADF, and the movable paper width regulating plate 12 for regulating the side edges of the document sheets carried. The paper width regulating plate 12 regulates the document D in the side direction on the basis of one side reference or center reference wherein two regulating plates are necessary.

In front, downstream side with regard to the document feeding, of the paper feed tray 11, there are provided the document leading edge stopper 201 which is fixed in the vicinity of the entrance portion of the paper feeding means 20, the upper guide plate 202, the lower guide plate 203, and the movable pressing plate 204 supported by a pivot around which it can be swung, its end portion being movable up and down. A plurality of document sheets D are placed on the paper feed tray 11, and the leading edge portion is made to pass over the movable pressing plate 204 until it touches the document leading edge stopper 201 to be stopped thereby. On this occasion of loading the tray with the document sheets D, the leading edge portion of the document D repels up the actuator 205 capable of swinging to cause the detecting sensor PS1 to issue an on-signal to establish the ADF mode.

The movable pressing plate 204 is driven by the motor (DC motor) M1 for pressing through an eccentric cam, and is capable of swinging around the pivot 206. The uppermost positon (pressing position) and the lowermost position (initial position) of the pressing plate 204 is determined by the drive control of the pressing motor M1 starting with the detection of the initial position by the positon sensor PS2 for the pressing plate.

In the document-feed-upstream side portion of the paper feeding means 20, there is provided conveying-out means composed of a movable pressing plate 204 and a pick-up roller 207 for conveying out the document sheet D by rotating under the pressure of the movable pressing plate 204. In the downstream side of the pick-up roller 207, there are provided a pair of rollers for separating and feeding (separating means) composed of the feed roller 208 rotating to drive and the reverse roller (separation roller) 209 pressing said feed roller 208. In the further downstream side of said separating and feeding roller pair, there are provided a registration roller 210 rotating to drive, and the registration pinch roller 211 rotating in the pressure contact with said registration roller.

The aforesaid pick-up roller 207, feed roller 208, reverse roller 209, and registration roller 210 are driven to rotate by the paper feeding motor (stepping motor) M2.

In the upstream side of the registration roller 210 in the paper feed path, there is provided a passage sensor PS3 for detecting the pass of the document sheet D. Further, in the downstream side of the registration roller 210, the registration sensor PS4 is provided.

Figure 3:
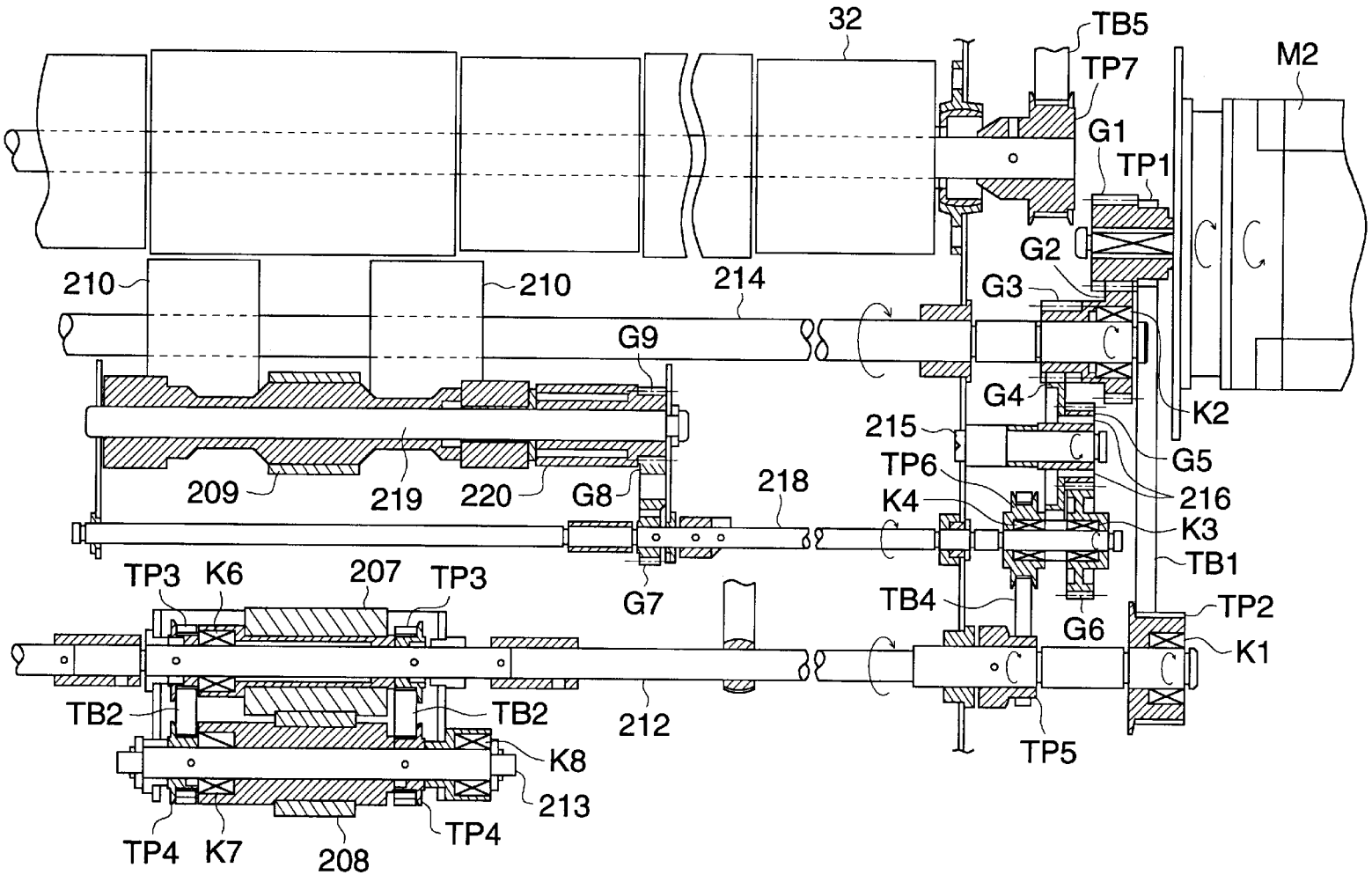
FIG. 3 is a cross-sectional view showing the drive system of said paper feeding means of said automatic document feeding apparatus.
Figure 4:
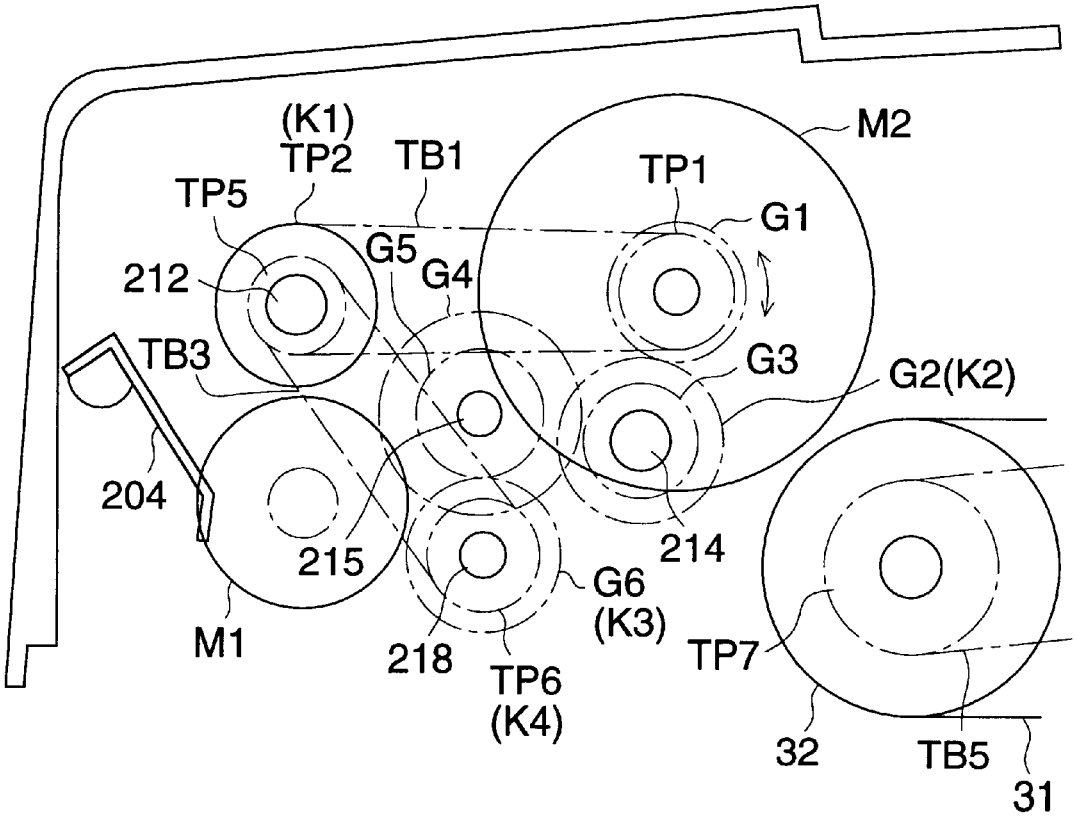
FIG. 4 is the front view of said drive system.

FIG. 3 is a cross-sectional view showing the drive system (drive means) of the paper feeding means of the automatic document feeding apparatus. Further, for the convenience of explanation, it is made to be a cross-sectional view with all the rotation shafts and the driving members developed on a plane. FIG. 4 is the front view of said drive system. Besides, in FIG. 4, the driving members such as the gears, the timing pulleys, and the timing belt are shown by single dot and dash lines.

The gear G1 and the timing pulley TP1 are fixed to the driving shaft of the paper feeding motor M2 capable of rotating in the normal and reverse directions. The timing pulley TP1 enables the timing pulley TP2, which is unitarily and integrally joined to the driving shaft 212 of the pick-up roller 207, to rotate through the timing belt TB1. The timing pulley TP2 has the built-in one-way clutch K1, which transmits driving force to rotate the pick-up roller in a normal way or does not transmit driving force at all according as the motor M2 rotates in the normal or reverse direction.

In the vicinity of the both side surfaces of the pick-up roller 207, there is provided the timing pulley TP3 on the driving shaft 212. The timing pulley TP3 enables the timing pulley TP4, formed unitarily and integrally with the driven shaft 213 of the feed roller 208, to rotate through the timing belt TB2.

The one-way clutch K6 and the one-way clutch K7 are provided in the vicinity of the timing pulley TP3 on the drive shaft 212 and in the vicinity of the timing pulley TP4 on the driven shaft 213 respectively. Further, at the other end of the driven shaft 213, the one-way clutch K8 is provided for use also as a bearing.

When the registration roller rotates in the normal direction to feed a sheet of original D and, at the same time, the reverse roller rotates reversely to prevent the double feeding of following original sheet D, upon passing of the trailing edge of the preceding original sheet D through the nip position of the reverse roller 209, the feed roller is driven to rotate reversely by the reverse rotation of the reverse roller pressing the feed roller, and at the same time, the pick-up roller 207 which is connected to the feed roller 208 with the timing belt TB2 is also driven in reverse way to give a force acting on the leading end portion of the following original sheet D to get back. In case of a number of following original paper sheets D being reversely transported, the leading end portion of the original sheets D are made to be apart from the feeding pressure point of the pick-up roller 207, resulting in the impossibility for a following original sheet D to be conveyed, which makes paper feeding failure.

By providing the one-way clutch K8 on the driven shaft of the feed roller 208, the reverse rotation of the feed roller following the reverse rotation of the reverse roller is prevented, and the feed roller is kept stationary so that the reverse transport of the original sheet D can be prevented.

On the other hand, the gear G1 meshes with the gear G2 which is fixed at the end of the driving shaft 214 of the registration roller 210 to transmit the rotary driving to the registration roller 210. The gear G2 has the one-way clutch K2 built-in to transmit drive force so as to rotate the registration roller 210 in the normal direction or no drive force according as the motor M2 rotates in the reverse or normal direction.

The gear G3 is formed unitarily and integrally with the gear G2. The gear G3 meshes with the gear G4 which is fitted rotatably to the fixed intermediate shaft 215 mounted to the side plate of the ADF mainframe to transmit the normal rotation to the gear G4. Around the center axis of the fixed intermediate shaft 215 the gear G5 is supported rotatably adjacent to the gear G4. The gears G4 and G5 are joined by a coupling means so that the normal and reverse rotation of the gear G4 is transmitted to the gear GS.

Figure 5:
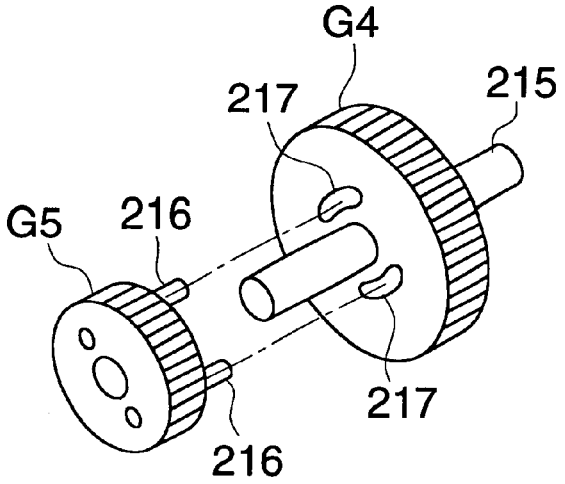
FIG. 5(*a*), 5(*b*), and 5(*c*) are a perspective view, the front view in normal rotation, and the front view in reverse rotation, each showing the coupling means, respectively.
Figure 5:
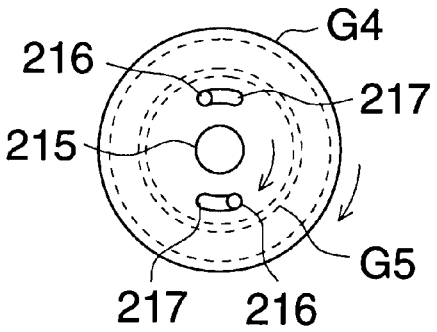
Figure 5:
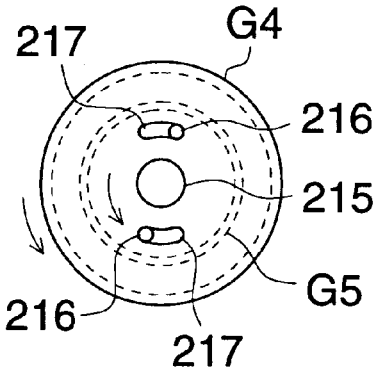

FIGS. 5(*a*) is a perspective view showing the coupling means for coupling the gears G4 and G5, FIG. 5(*b*) is the front view in normal rotation, and FIG. 5(*c*) is the front view in reverse rotation.

The two pins 216 are planted on the side of the gear G5 facing the gear G4. On the side of the gear G4 facing the gear G5, circular-arc-shaped long slots 217 are carved in two positions so that the pins 216 are capable of moving along the circle.

When the gear G4 rotates in the normal direction, as shown in FIG. 5(*b*), the pins 216 engage with the one end portion of the long slots 217 in the gear G4 respectively, transmitting drive force to rotate the gear G5 clockwise in the normal direction.

Upon switching of the gear G4 from the normal rotation to the reverse rotation, as shown in FIG. 5(*c*), the two pins 216 of the gear G5 moves from the position of the normal rotation (the position shown in FIG. 5(*b*)) to engage with the other end portion of the long slots 217 in the gear G4 respectively, transmitting drive force to rotate the gear G5 counterclockwise. On the occasion of switching from the normal to the reverse rotation, due to an idle time (several milliseconds) until the pins 216 reach the other ends from the time when they start from the one ends to move along the long slots, the start of rotation of the gear G5 is delayed by this elapsed time for passing over the long slots.

Accordingly, the reverse roller 209 connected to the gear G5 starts to rotate in the reverse direction several milliseconds after the start of rotation of the registration roller 210 which rotates simultaneously with the gear G4. By the time difference established in this way, after the registration roller starts to rotate and securely holds the leading end portion of the document sheet D with the registration pinch roller 211, the reverse roller starts to rotate in the reverse direction to operate in such a manner as to make the following document sheets D get back for preventing double feeding, hence the performance of the paper feeding is improved.

Next, the gear G5 meshes with the gear G6 provided at the end of the driving shaft 218 for driving the reverse roller 209. The one-way clutch K3 is contained in the gear G6. On the driving shaft 218, there is fixed the gear G7, which is connected to the gear G9 through the idle gear G8. The gear G7 is unitarily and integrally formed with the torque limiter 220 supported rotatably by the fixed supporting shaft 219, and makes the reverse roller rotate with a predetermined torque.

The timing pulley TP5 fixed to the driving shaft 218 driving the pick-up roller 207 transmit drive force to the timing pulley TP6, which is provided adjacent to the gear G6 at the end portion of the driving shaft 218, through the timing belt TB3. The one-way clutch K4 is contained within the timing pulley TP6.

Due to the one-way clutches K3 and K4 provided at the driving shaft 218 of the reverse roller, the driving force for rotating the roller always in one direction is transmitted to the reverse roller 209, regardless of whether the paper feeding motor M2 rotates in the normal or reverse direction.

The reverse roller 209 is driven in the reverse direction to the advancing of the original sheet D through the torque limiter 220, and pressed to the feed roller 208 with the pressure generated by the action of the torque given by the torque limiter 220 as well as the initial pressure by the pressing spring (not shown in the drawing). The reverse roller 209 rotates, driven by the feed roller 208, in accordance with its rotation, the torque limiter slipping by a force exceeding the torque limit, in the case where it is in direct contact with the feed roller 208 (where there is no original sheet in the nip), or in the case where only one original sheet D is fed in the nip. However, if two or more sheets of original D are fed into the nip, the limit torque of the torque limiter 220 is larger than the frictional force between the sheets of the original D, hence the reverse roller is rotated in the reverse direction to push back the sheet of the original D in the lower side, preventing double feeding.

Figure 6:
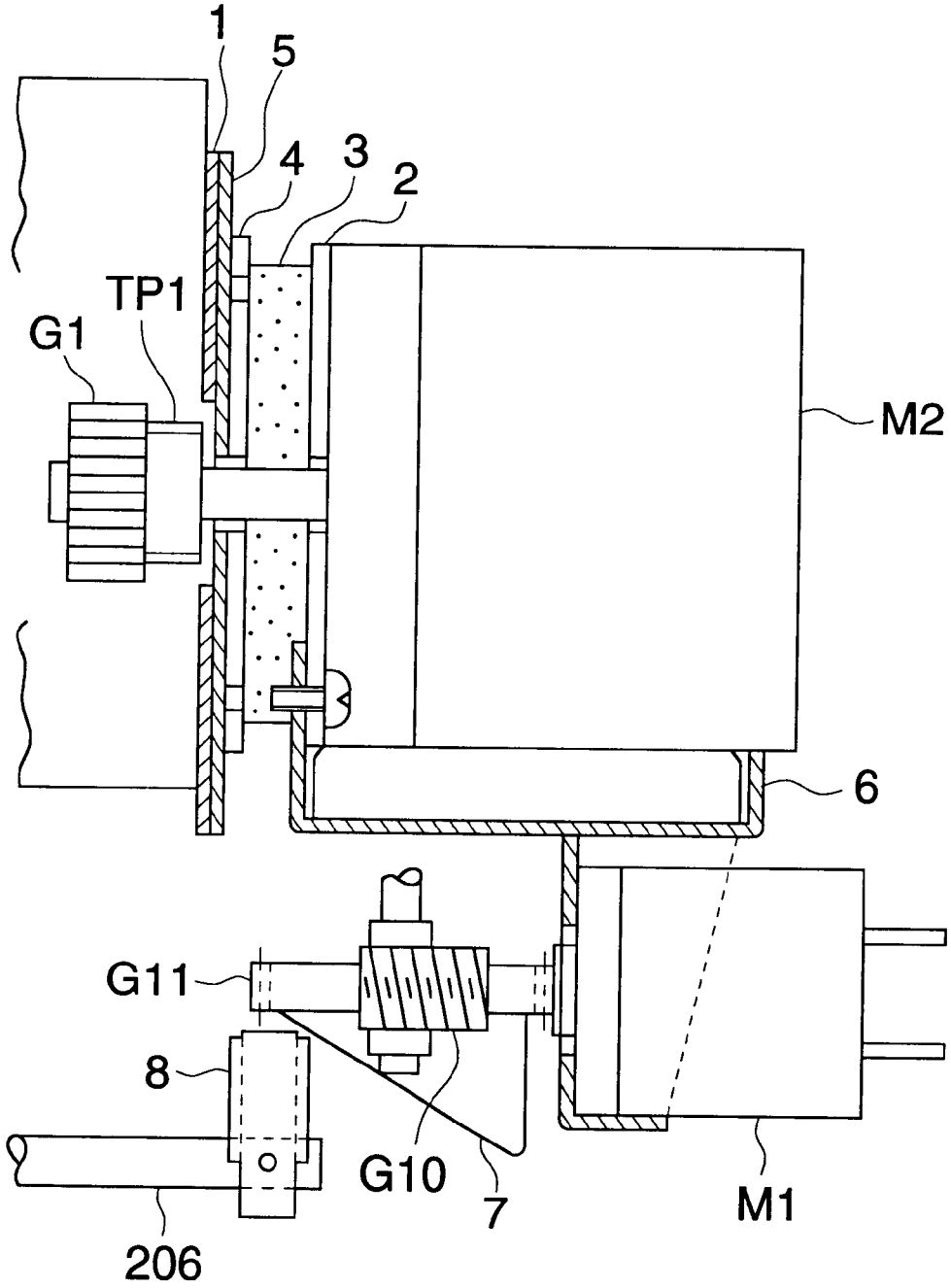
FIG. 6 is the plan showing the mounting of the motor for pressing and the motor for paper feeding to the document feeder mainframe.

FIG. 6 is the plan showing the mounting of the pressing motor M1 and the paper feeding motor M2 to the document feeder mainframe.

On the mounting side of paper feeding motor M2 (first drive motor, stepping motor) capable of rotating in both normal and reverse directions, the first supporting plate 2, the elastic buffer member 3, and the second supporting member 4 are integrally built up, welded to one another to form a lamination layer. The second supporting member 4 is fixed to the paper feeding apparatus mainframe through the fitting plate 5. Further, the gear G1 of the drive system (drive means) shown in FIG. 3 and FIG. 4 and the timing pulley TP1 are fixed to the driving shaft of the paper feeding motor M2.

One side portion of the supporting member 6 is fixed to the first supporting plate 2 by screws or the like. The supporting member 6 has a U-shaped cross-section and its one side surface engages with the side surface of the paper feeding motor M2 for positioning. To the supporting member 6, the pressing motor M1 (second drive motor, DC motor) capable of rotating in both normal and reverse directions is fixed by screws or the like. Further, the worm gear G10 is fixed to the driving shaft of the pressing motor M1. The worm gear G10 meshes with the worm wheel (gear) G11 to transmit rotation. The cam portion 7 is integrally formed on the worm wheel G11. The cam portion 7 rotating together with the rotation of the worm wheel G11 engages with the follower 8 to swing the moving shaft 206 up and down, which makes the movable pressing plate 204 swing up and down. The end portion of the swinging movable pressing plate 204 is actuated to move up and down, so that it presses and is retracted from the outer surface of the pick-up roller 207.

According to the document feeder of this invention, the pressing motor M1 is not directly fitted to the document feeder mainframe, but it is fitted to the paper feeding motor M2 through the elastic buffer member provided on it, hence the vibration and the abnormal noise are absorbed by the buffer member, suppressing the noise to achieve quietness with the appratus.

Figure 7:
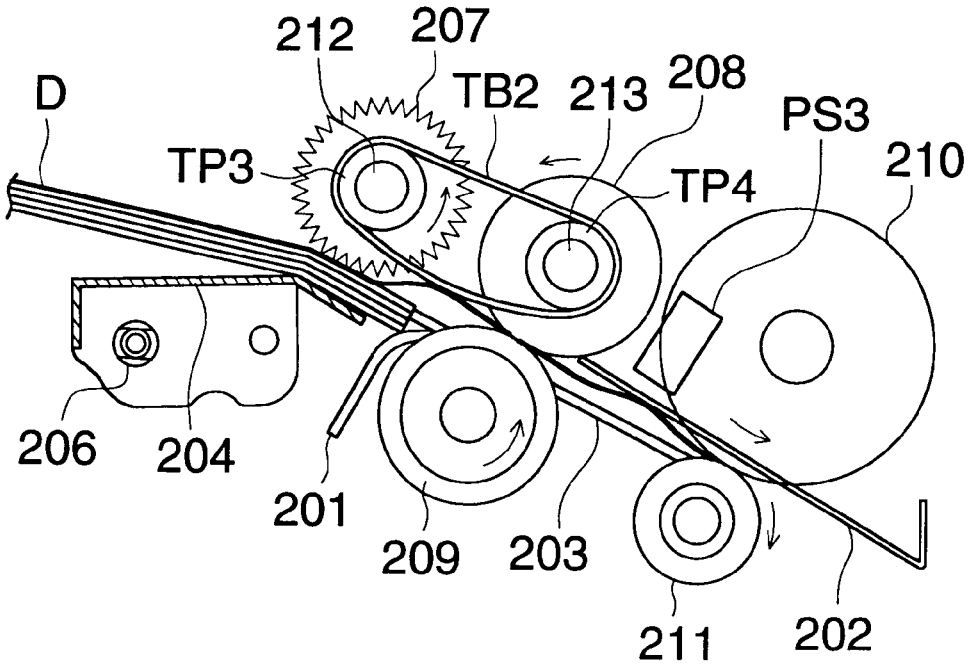
FIG. 7 is the front view of the principal portion of said paper feeding means.

FIG. 7 is the front view of the principal portion of the paper feeding means 20.

The endless-type timing belt TB2 is entrained around the timing pulley TP3 fixed to the drive shaft 212 of the pick-up roller 207 and the timing pulley TP4 fixed to the driven shaft 213 of the feed roller 208. According to this invention, the number of the teeth Z1 of the timing pulley TP3 is made to be 19, and the number of the teeth Z2 of the feed roller 208 to be 20, and the outer diameter of the pick-up roller 207 is made to be 21 mm and that of the feed roller to be 20 mm; the range to be traversed by the document sheet D driven by the pick-up roller becomes larger than that by the feed roller 208 by about 5% due to the difference in the gear (20/19= about 1.05), and by about 5% (21/20=about 1.05) due to the difference in the outer diameter, by about 10% added together.

Accordingly, in the document transport path from the conveying-out position of the original sheet D by the pick-up roller 207 and the movable pressing plate 204, to the nip position of the feed roller 208 and the reverse roller 209, the sheet of the original D forms bending due to the difference between the ranges to be traversed by the original sheet driven by both rollers respectively.

The pick-up roller 207 and the feed roller 208, after starting to rotate for feeding the document sheet D, continue to rotate until leading end portion of the document sheet D reaches the position a little in advance of the nip position of the registration roller 210 a predetermined time later than the time when it passes the passage sensor PS3. In this process of paper feeding, a bending of the document sheet D is formed between the pick-up roller 207 and the feed roller 208 due to said difference between the ranges, hence on the occasion of feeding the document sheet D by the feed roller 208, the load to the feed roller 208 given by pulling the document sheet to each other by each of the rollers is eliminated.

Further, in FIG. 7, a high-friction material having a high coefficient of friction is formed on the back surface (outer circumferential surface) of the timing belt TB2 entrained around the timing pulley TP3 and the timing pulley TP4. As for the high-friction material, it is selected from an ethylene-propyrene rubber (EPDM), an acrylonitryl-butadiene rubber (NBR), a chloroprene rubber (CR), a butadiene rubber (BR), a styrene-butadiene rubber (SBR), a butyl rubber (IIR), an isoprene rubber (IR), and a natural rubber, and so forth. Besides, the outer surface of the high-friction material has an appropriate degree of surface roughness.

In the document transport path from the conveying-out positon of the original sheet D by the pick-up roller 207 and the movable pressing plate 204, to the nip position of the feed roller 208 and the reverse roller 209, in the case where the document sheet D with a high-degree curling is fed into it, sometimes the leading end portion of the document sheet D can not be transported to the nip position of the feed roller 208 and the reverse roller 209 by the pick-up roller only. However, by employing the timing belt TB2 made up of said high-friction material, the leading end portion of the document sheet D engages with the outer surface of the timing belt TB2, with the transporting force increased by the high coefficient of friction for holding, and is fed securely into the nip position of the feed roller 208 and the reverse roller 209.

The transport belt 31 shown in FIG. 1 is entrained in a manner capable of revolving around the drive roller 32, the idle roller 33, the original pressing rollers 34, 35A, 35B, and 35C, and the tension roller 36. The drive roller 32 is formed integrally with the timing pulley TP7 which is driven to rotate by the transport motor M3 (stepping motor) through the timing belt TB5.

The original sheet D fed from the aforesaid paper feeding means to the transport means 30 is moved on the glass platen 101 by the transport belt 31, until it stops with the stopping of revolution of the transport belt 31 after passage of a predetermined time from the time when the passage of the trailing edge of the original sheet D is detected by the aforesaid registration sensor PS4. The transport belt 31 is switched to reverse revolution immediately after stopping, and stops revolving when it makes the trailing edge of the document sheet D hit the original stopper 102. In this stationary state of the original sheet, the image on the front side of the original sheet D is read by the scanning exposure by the exposure optical system. The original sheet D after exposure is conveyed out by the paper discharging means 40.

The original sheet D fed into the paper discharging means 40 by said transport belt 31, after the passage of its leading edge detected by the paper discharge sensor PS5, is further fed into the nip position of the discharge-inverting roller 41 and the discharging roller 42, passes through the path along the discharging guide plate, further passes through the path between the guide plate 46 and the upper surface of the switching finger 45 in case of the ADF mode for the single-sided original, and finally ejected out of the apparatus body to be placed on the exit tray portion 49. Said discharge sensor PS5 executes the detection of the passage of the leading edge of the original sheet and the detection of a paper jam.

In case of R-ADF mode for the double-sided original, the aforesaid switching finger 45 is driven by the solenoid SD to switch the transport path for the original sheet D, so that the original sheet D, held between the transport belt which is switched to reverse rotation driving and the glass platen 101, is inverted and moves reverse way on the glass platen 101 until it is stopped by hitting the original stopper 102. In this stationary state of the original, the image on the reverse side of the original sheet D is read by the scanning exposure by the exposure optical system. The original sheet D after exposure, in the same way as the case of the aforesaid ADF mode, is ejected out of the apparatus body by the paper discharging means 40.

In the following, the original feed control for the paper feeding means of the automatic document feeding apparatus according to this invention will be explained.

Figure 8:
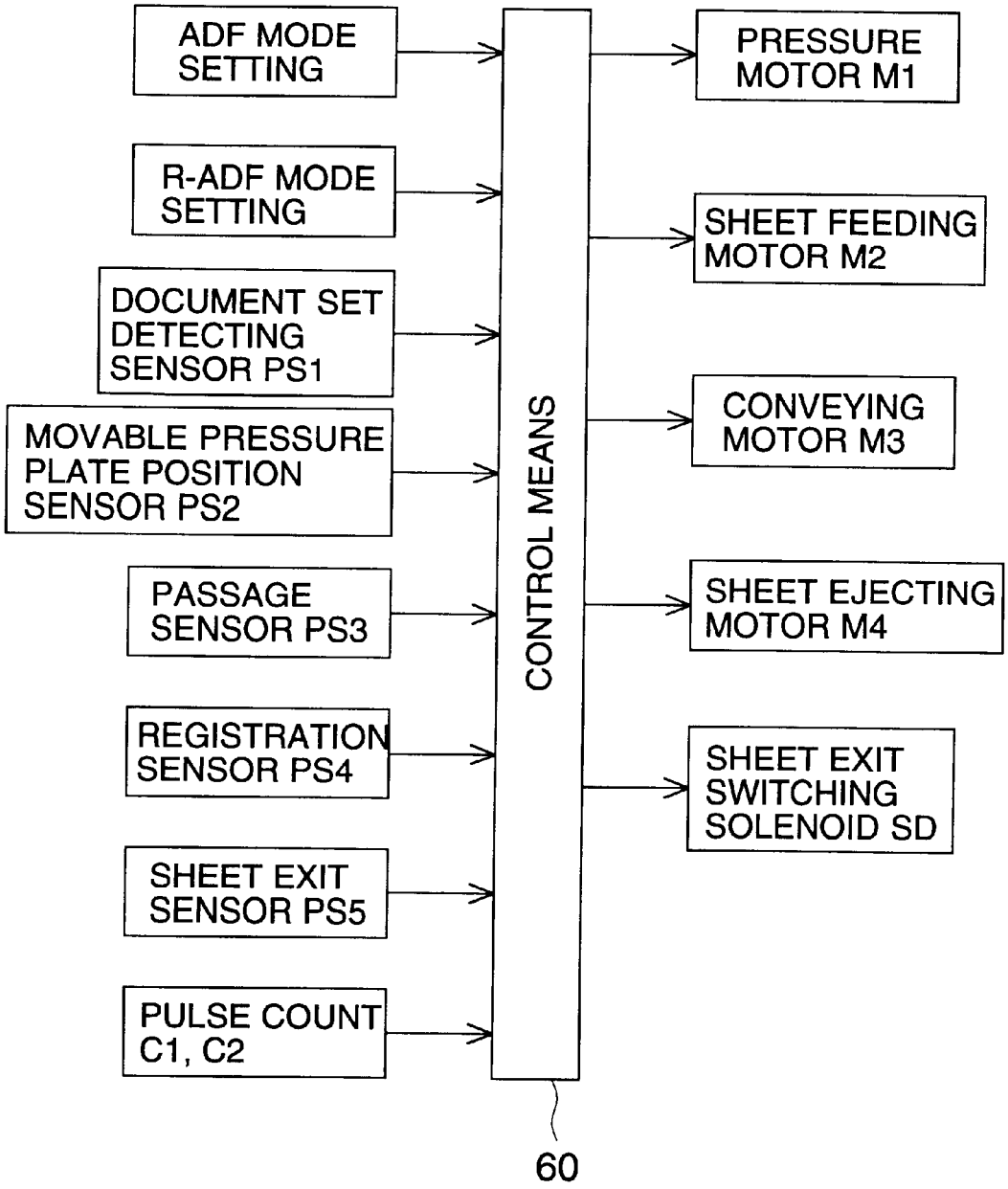
FIG. 8 is a block diagram showing the structure of the principal portion of the drive system control for said paper feeding means of said automatic document feeding apparatus.

FIG. 8 is a block diagram showing the structure of the principal portion of the drive system control for the paper feeding means of the automatic document feeding apparatus, and the control of the each operation of the original feeding, reverse transport of the original, transport, and discharging is executed by the control means (CPU) 60. That is, the leading edge of the document sheet D separated and conveyed by the paper feeding means 20 is detected by the original setting detecting sensor PS1, the movable pressing plate position sensor PS2, the passage sensor PS3, and the registration sensor PS4 to input the detect signals in the control means 60. The original sheet D conveyed from the paper feeding means 20 slides on the glass platen 101 by the revolving transport belt 31, and after it is subjected to the exposure process, its leading edge is detected by the discharge sensor PS5 provided at the side of the discharging means 40 to input the detect signal in the control means 60. These input signals are processed by the control means 60 for controlling the drive by said motors M1 through M4.

Figure 9:
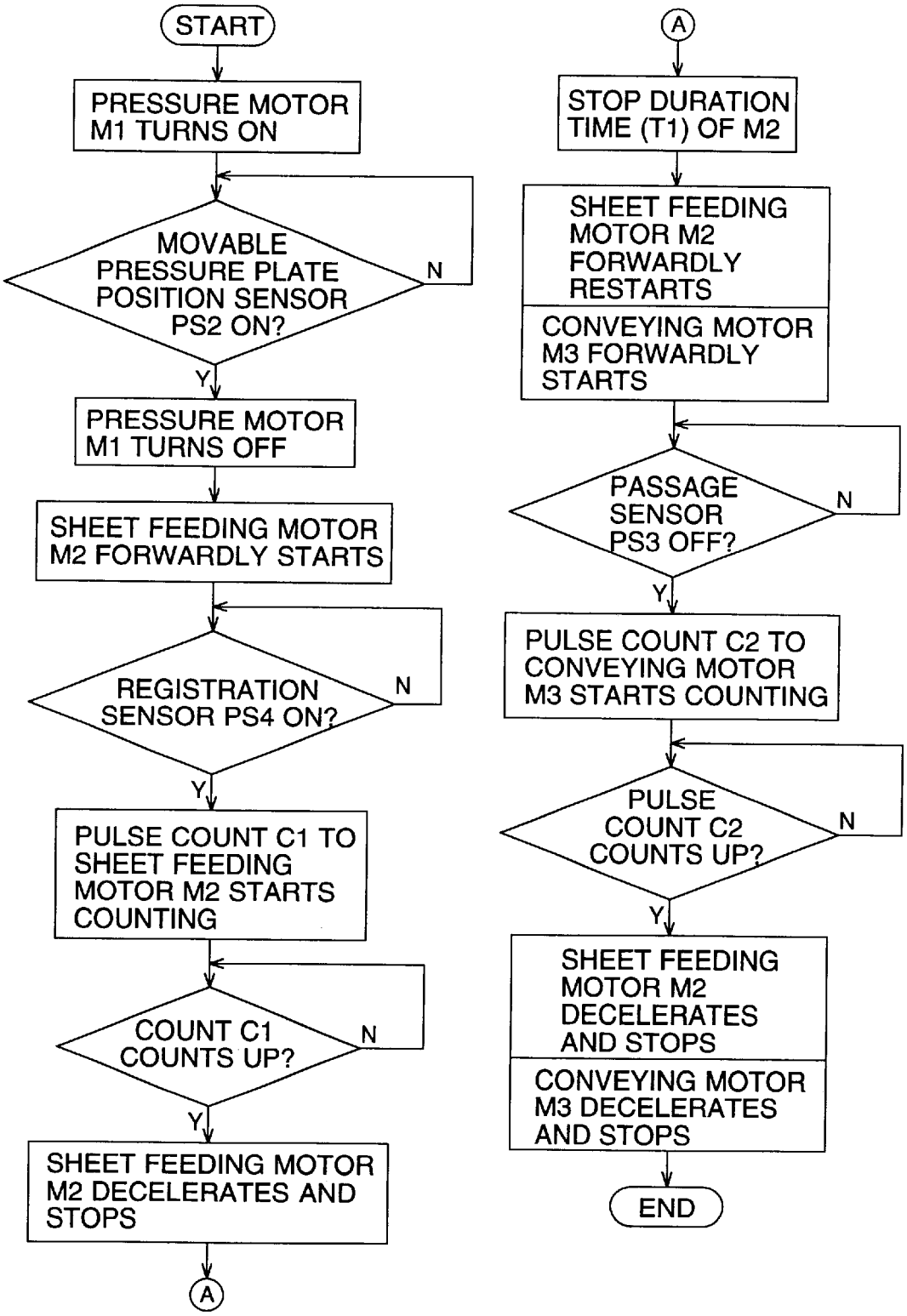
FIG. 9 is a flow chart showing the process of paper feeding by said paper feeding means.
Figure 10:
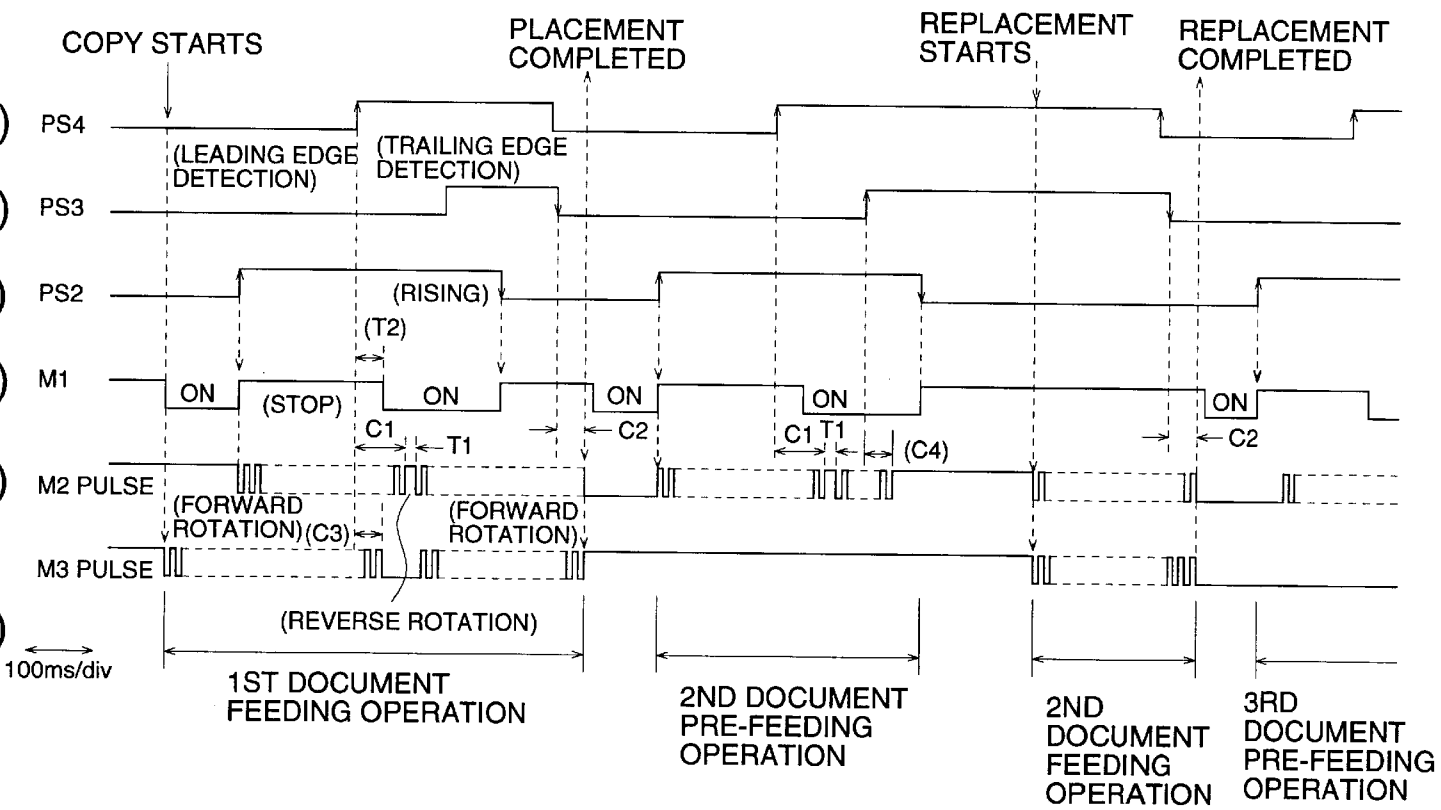
FIGS. 10(*a*)–10(*g*) are timing charts showing the control for said paper feeding means.

FIG. 9 is a flow chart showing the process of paper feeding by the paper feeding means 20, and FIGS. 10(*a*) through 10(*g*) are timing charts showing the control for the paper feeding means 20.

(1) When a stack of document sheets D is placed on the paper feed tray 11 and the movable pressing plate 204, and the leading edge portion of the document sheets is made to push the original leading edge stopper 201, the original setting detecting sensor PS1 becomes on and the ADF mode is displayed on the operation panel.

(2) Upon depressing the copy start button, the control for the paper feeding means starts in response to the original feed start signal. That is, in response to the original feed start signal, the pressing motor M1 starts rotation for driving, and the movable pressing plate 204 swings upward around the pivot 206 by the cam, to cause the end portion of the movable pressing plate 204 to move up to the pressing position against the pick-up roller 207, thus the stack of the original is pressed to contact it. When the uprising of the movable pressing plate is detected by the movable pressing plate position sensor PS2, the driving of the pressing motor M1 is stopped and the pressing is continued.

(3) At the same time when the driving of the pressing motor M1 is stopped, the normal rotation driving of the paper feeding motor starts together with the start of normal rotation of the pick-up roller 207, the feed roller 208, the registration roller 210, causing the feeding of the original D to start, and a sheet of the original D is separated and conveyed.

(4) When the leading end portion of the original sheet D, which has been separated and conveyed from the nip position of the feed roller 208 and the reverse roller 209, passes the registration sensor PS4, in response to the passage signal, the pulse count C1 for the paper feeding motor M2 by the pulse counter starts counting up to convey the original sheet D.

(5) By the counting up to a predetermined number by the pulse count C1, the paper feeding motor is decelerated to stop.

(6) After the counting up of the pulse count C1, the paper feeding motor is stopped for a predetermined time period T1, then the paper feeding motor M2 restarts to rotate for driving in the normal direction. Further, approximately at the same time, the transport motor M3 starts to rotate for driving in the normal direction.

(7) When the passage of the trailing edge of the original sheet D is detected by the passage sensor PS3, an off signal is generated, and the pulse count C2 by the pulse counter starts for count up for the transport motor M3.

(8) By the counting up to a predetermined number by the pulse count C2, the transport motor M3 is decelerated to stop. At the same time, the paper feeding motor M2 is also decelerated to stop. The first original sheet feeding is completed through the operations explained up to now.

(9) While the first sheet of the original D is subjected to the exposure process on the glass platen 101 and fed into the discharging means 40, the preliminary feeding operation of the successive second original sheet starts.

Figure 11:
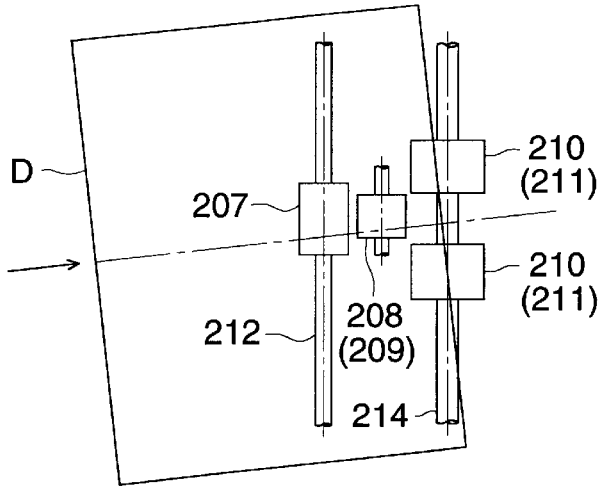
FIGS. 11(*a*), 11(*b*), and 11(*c*) are the plans showing the paper feeding operation by said paper feeding means.
Figure 11:
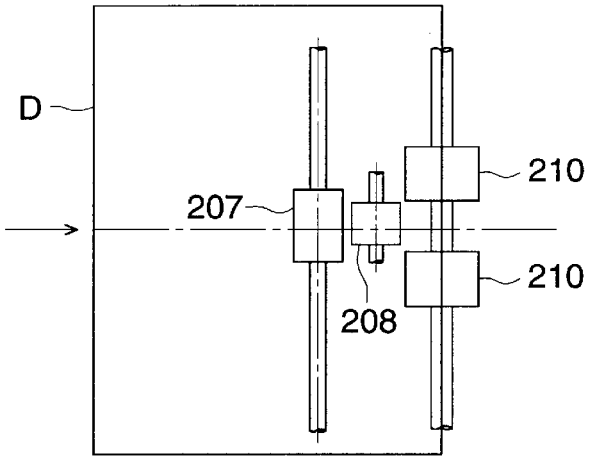
Figure 11:
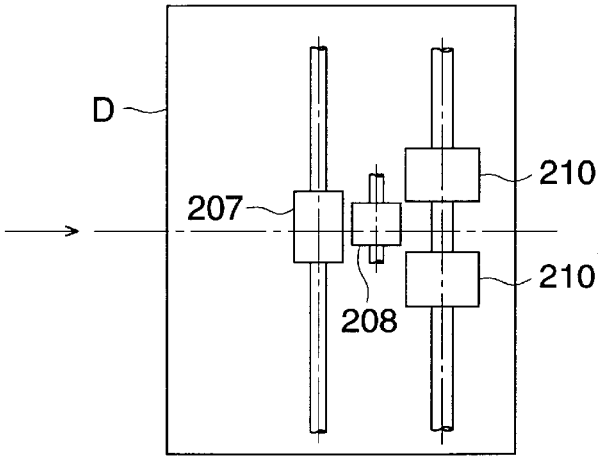

FIGS. 11(*a*), 11(*b*), and 11(*c*) are the plans showing the paper feeding operation of the paper feeding means 20 of this invention.

(1) By the normal rotation driving of the paper feeding motor M2, the original sheet D is fed to the nip position of the registration roller 210 and the registration pinch roller 211, passing the pick-up roller 207 and the feed roller 208. On this occasion, the registration roller 210 is not rotating as is explained in the aforesaid paragraph (6), hence only a part of the leading edge portion of the original sheet D which has been conveyed with its posture skewed engages with the outer surfaces of the rollers in the vicinity of the nip position of the registration roller 210 and the registration pinch roller 211, where it is stopped as it is skewed (refer to FIG. 11(*a*)).

(2) Because the range supposed to be passed by the conveyed original sheet D is longer than the path up to the nip position of the registration roller 210, the leading edge portion of the document sheet D is pushed to the upstream side of conveying by the normal rotation driving of the pick-up roller 207 and the feed roller 208, so that the leading edge line of the original D can be made to be in parallel with the edge line of the nip portion of the registration roller 210 and the registration pinch roller 211 (refer to FIG. 11(*b*)).

(3) Next, by the reverse rotation driving of the paper feeding motor M2 to rotate the registration roller 210, the leading end portion of the document sheet D, which has been made to be in parallel with said edge line of the nip, is conveyed by the rotating registration roller 210, hence the document sheet D can be fed to the glass platen 101 with its skew corrected (refer to FIG. 11(*c*)).

As has been explained in the above, owing to the arrangement of four one-way clutches, the summed up total of the one-way clutch K1 provided at the driving shaft 212 of the pick-up roller 207, the one-way clutch K2 provided at the driving shaft 214 of the registration roller 210, and the one-way clutches K3 and K4 provided at the driving shaft 218 of the reverse roller 209 and the control for the switching between the normal and reverse rotations of the paper feeding motor M2, the original sheet D conveyed as skewed has been made to be corrected for its skew at the nip position of the registration roller 210 and fed exactly to the glass platen 101.

Further, the paper feeding apparatus according to this invention can be applied to a manual paper feeding apparatus for the recording paper, an intermediate paper stacking tray in the double-sided recording apparatus, and so forth, in addition to the aforesaid automatic document feeding apparatus.

In the paper feeding apparatus of this invention, the correction operation for the skew of the paper sheet is securely and easily practiced by employing the driving shafts having one-way clutches built-in and the switching between normal and reverse rotations of the paper feeding motor. Further, because a high-cost electromagnetic clutch is not employed, it is effective for decreasing the manufacturing cost, and accomplishes the object to eliminate the noises such as the shock noise generated at the time of actuation of an electromagnetic clutch, resulting in quiet operation.

Furthermore, in the paper feeding apparatus of this invention, the original sheets are pressed until a sheet reaches the nip position of the registration roller by the movable pressing plate positioned under the pick-up roller, hence it is prevented the poor paper feeding such that the paper sheet does not reach the registration roller.

Further, in the paper feeding apparatus of this invention, the range to be passed by the conveyed paper sheet by the pick-up roller is longer than that by the feed roller, hence it is prevented the poor paper feeding such that the paper sheet does not reach the registration roller due to the reversing operation of the reverse roller which surpasses the conveying operation of the feed roller.

Besides, in the paper feeding apparatus of this invention, the reverse rotation of the reverse roller is made to start through a coupling means after the time passage of several milliseconds from the time when the registration roller starts to rotate, hence it is prevented the poor paper feeding such that the paper sheet is made to move backward by the reverse rotation of the reverse roller due to the simultaneous starting of rotation of the registration roller and the reverse roller by the reverse rotation driving of the drive motor, causing the leading end portion of the paper sheet to be retracted apart from the nip position of the registration roller so that the conveying by the registration roller can not be carried out, and the reliability of paper feeding is enhanced.

According to the paper feeding apparatus of this invention, by mounting the pressing motor to the paper feeding motor provided with an elastic buffer member, the vibration and the abnormal noise generated in the pressing motor rotating in the normal and reverse direction are absorbed by the buffer member, which makes the apparatus quiet in operation.

According to the paper feeding apparatus of this invention, while the feed roller is not rotated and the reverse roller is rotated reversely, due to the one-way clutch fitted to the driving shaft of the feed roller, it is prevented for the feed roller to be driven by the reverse roller to rotate reversely, which prevents the moving-backward of the paper sheet.

Further, according to the paper feeding apparatus of this invention, a high-friction material, as an assisting means for conveying the paper sheet to the reverse roller, is used on the back surface of the timing belt for transmitting the driving force to the feed roller to be provided with also the function of a feed roller, hence the poor paper feeding for curled paper sheets is prevented.

What is claimed is:

1. A sheet feeding apparatus comprising:

(a) pick up means for picking up and feeding sheets stacked on a sheet feeding tray;

(b) separating means having a feed device which rotates only in a feeding direction of the sheets and a reverse roller which is driven only in a direction opposite to the feeding direction of the sheets for separating a single sheet from said sheets fed by said pickup means;

(c) sheet feeding means having paired registration rollers for aligning and thereafter feeding said separated single sheet;

(d) driving means for driving said pickup means, said separating means and said sheet feeding means, said driving means comprising a driving motor, a coupling in a drive transmitting path between said driving motor and said reverse roller for generating a delay period of time between forward and backward rotations of said driving motor; and a torque regulator between said coupling and said reverse roller for interrupting a driving force from said driving motor for a predetermined time; and (e) control means for controlling a drive of said driving means so that, when said control means directs the driving motor to rotate forward, the single sheet, which has been picked up and separated by said pickup means and said separating means, collides with circumferential surfaces of the paired registration rollers which are stopped, thereby to align the single sheet for feeding, and when said control means directs the driving motor to rotate backward, the paired registration rollers start to feed the single sheet while said reverse roller stops rotating for said predetermined time and, thereafter, said coupling causes the reverse roller to start rotating in the direction opposite to said feeding direction of the sheet.

2. The sheet feeding apparatus of claim 1, wherein the sheet is an original document, and said sheet feeding means is used for an automatic document feeder, which feeds the original document to a platen glass.

* * * * *